US006067712A

United States Patent [19]

Randlett et al.

[11] Patent Number: 6,067,712

[45] **Date of Patent: *May 30, 2000**

[54] HEAT EXCHANGE TUBE WITH EMBOSSED ENHANCEMENT

[75] Inventors: Myron R. Randlett, Cuba, Mo.; Ralph L. Webb, State College; Louay M. Chamra, University Park, both of Pa.

[73] Assignee: Olin Corporation, East Alton, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/814,163

[22] Filed: Mar. 10, 1997

Related U.S. Application Data

[63] Continuation of application No. 08/442,229, May 15, 1995, abandoned, which is a continuation-in-part of application No. 08/167,556, Dec. 15, 1993, Pat. No. 5,415,225.

[51] Int. Cl.[7] ..... F28F 13/12

[52] U.S. Cl. ..... 29/890.053; 29/890.045; 165/109.1; 165/133; 165/184

[58] Field of Search ..... 165/109.1, 133, 165/179; 29/890.053, 890.045

[56] References Cited

U.S. PATENT DOCUMENTS

| | | | |
|---|---|---|---|
| 2,978,797 | 4/1961 | Ekelund . | |
| 3,457,990 | 7/1969 | Theophilos et al. . | |
| 3,496,752 | 2/1970 | Kun et al. . | |
| 3,696,861 | 10/1972 | Webb . | |
| 3,768,290 | 10/1973 | Zatell . | |
| 3,768,291 | 10/1973 | Rieger | 165/179 X |
| 3,789,915 | 2/1974 | Ford . | |
| 3,861,462 | 1/1975 | McLain . | |
| 3,885,622 | 5/1975 | McLain . | |
| 3,906,605 | 9/1975 | McLain . | |
| 3,991,822 | 11/1976 | Morris . | |
| 4,044,797 | 8/1977 | Fujie et al. . | |
| 4,118,944 | 10/1978 | Lord et al. . | |
| 4,223,539 | 9/1980 | Webb et al. . | |
| 4,314,587 | 2/1982 | Hackett | 165/184 X |

(List continued on next page.)

FOREIGN PATENT DOCUMENTS

| | | | |
|---|---|---|---|
| 2058127 | 6/1992 | Canada . | |
| 2032891 | 2/1971 | Germany | 165/133 |
| 448456 | 5/1949 | Italy | 165/179 |
| 83189 | 5/1983 | Japan | 165/133 |
| 59-29997 | 2/1984 | Japan . | |
| 60-2161990 | 10/1985 | Japan . | |
| 61-143696 | 7/1986 | Japan . | |
| 175486 | 8/1986 | Japan | 165/179 |
| 213495 | 9/1986 | Japan | 165/179 |
| 280390 | 12/1986 | Japan | 165/179 |
| 62-37693 | 2/1987 | Japan . | |
| 64-87036 | 3/1989 | Japan . | |
| 2-108411 | 4/1990 | Japan . | |
| 203796 | 7/1992 | Japan | 165/133 |
| 565027 | 10/1944 | United Kingdom | 165/179 |

OTHER PUBLICATIONS

A Survey of the Effects of Small Protuberances on Boundary–Layer Flows, Raymond Sedney, AIAA Journal, vol. 11, No. 6, Jun. 1973, pp. 782–791.

"Development of Various High Efficiency Heat Trabsfer Copper Tubing" by Y. Shinohara, Hitachi Cable, Ltd. Japan. p. 90/313 (1990) International Wrought Copper Council.

*Primary Examiner*—Leonard Leo

*Attorney, Agent, or Firm*—Wiggins & Dana; Gregory S. Rosenblatt

[57] ABSTRACT

There is provided heat exchange tube formed from a ductile metal strip which is formed into a generally circular configuration with the opposing longitudinal edges of the strip welded together. Both surfaces of the strip are enhanced. One surface of the tube is enhanced with protrusions in the shape of truncated cones. The ratio of the pitch between longitudinally aligned protrusions and transversely aligned protrusions maximizes the formation and maintenance of vortexes in a flowing fluid along the tube surface.

14 Claims, 5 Drawing Sheets

U.S. PATENT DOCUMENTS 4,330,036 5/1982 Satoh et al. ..... 165/179
4,402,359 9/1983 Carnavos et al. ..... 165/133 X
4,438,807 3/1984 Mathur et al. .
4,561,497 12/1985 Nakajima et al. .
4,602,681 7/1986 Daikoku et al. .
4,621,953 11/1986 McGuth ..... 138/39 X
4,654,163 3/1987 Kuwahara et al. .
4,658,892 4/1987 Shinohara et al. .
4,660,630 4/1987 Cunningham et al. ..... 165/133
4,678,029 7/1987 Sasaki et al. .
4,690,211 9/1987 Kuwahara et al. ..... 165/177
4,715,436 12/1987 Takahashi et al. ..... 165/133
4,905,885 3/1990 Hellman, Sr. .
5,070,937 12/1991 Mougin et al. ..... 165/133
5,184,674 2/1993 Keyes .
5,353,865 10/1994 Adiutori et al. ..... 165/133
5,361,828 11/1994 Lee et al. ..... 165/109.1
5,577,555 11/1996 Hisajima et al. ..... 165/133

HEAT EXCHANGE TUBE WITH EMBOSSED ENHANCEMENT

CROSS REFERENCE TO RELATED APPLICATIONS

This application is a continuation of application Ser. No. 08/442,229 filed May 15, 1995, now abandoned. The parent application is incorporated herein by reference in its entirety.

This patent application is a continuation in part of U.S. patent application Ser. No. 08/167,556 entitled "Heat Exchange Tube with Embossed Enhancements" by M. R. Randlett et al. that is now U.S. Pat. No. 5,415,225.

FIELD OF THE INVENTION

This invention relates to heat exchange surfaces. More particularly, a welded metal tube is enhanced on two opposing surfaces. Parallel rows of fins are formed on one surface. The opposing surface contains protrusions effective to generate planar surface turbulence in a fluid.

BACKGROUND OF THE INVENTION

In certain refrigeration and air conditioning applications, a heat exchange unit has a liquid refrigerant flowing within a tube while the fluid to be cooled flows externally over the tube. Liquid refrigerants such as trichloromonofluoromethane or dichlorodifluoromethane flow through the tube. As the liquid refrigerant absorbs heat from the external liquid, the refrigerant is changed to a gas. The gas phase refrigerant is returned to a compressor, compressed to a liquid and returned to the heat exchange tube for another cycle.

One method to form the tubes involves passing a metallic strip through forming rolls to transform the strip into an ellipsoid with longitudinal edges adjacent one another. The edges are then welded together to form a tube. This process is disclosed in U.S. Pat. No. 4,995,549 to Hellman, Sr., which is incorporated by reference in its entirety herein.

To increase the efficiency of heat transfer through the tube, the inner or outer surface of the tube may be enhanced. Enhancements consist of fins, protrusions or other shapes which increase the surface area. A plurality of parallel fins is disclosed in U.S. Pat. No. 4,658,892 to Shinohara et al. while truncated pyramids are disclosed in U.S. Pat. No. 5,070,937 to Mougin et al., both of which are incorporated by reference in their entirety herein.

Another method to increase the heat transfer is by facilitating nucleate boiling. As the refrigerant changes state from a liquid to a vapor, a large quantity of heat is absorbed from the fluid. In nucleate boiling, liquid adjacent to a trapped vapor bubble is super heated by the heat exchange surface. Heat is transferred to the bubble at the liquid vapor interface. The bubble grows in size until surface tension forces are overcome by buoyancy and the bubble breaks free from the surface. As the bubble leaves the surface, fresh liquid wets the now vacated area. The remaining liquid absorbs heat from the tube surface to form the next bubble. The vaporization of liquid and continuous stripping of the heated liquid adjacent to the heat transfer surface, together with the convection effect due to the agitation of the liquid pool by the bubbles, results in an improved heat transfer rate for the heat exchange surface.

One effective nucleate boiling site is a channel adjacent to a surface of the heat exchange tube for transport of the liquid. This channel has narrow openings through which the vapor bubbles escape. The openings are sufficiently small to effectively retain the trapped vapor bubbles until super heated.

The manufacture of nucleate boiling sites is disclosed in U.S. Pat. Nos. 3,696,861 to Webb and 4,059,147 to Thorne. Fins are formed on a heat exchange surface and then bent such that the tip of one fin is in close proximity to a mid-point of an adjacent fin. A channel is formed at the base of the fins and a narrow aperture sufficiently small to promote and sustain nucleate boiling of a fluid forms where a fin tip abuts an adjoining fin. Both the Webb and the Thorne patents are incorporated in their entirety by reference herein.

One method of enhancing a tube is to emboss a desired pattern into the metallic strip prior to forming the strip into a tube. The longitudinal edges of the enhanced strip are then welded together. U.S. Pat. Nos. 3,861,462 and 3,902,552, both to McLain and both incorporated by reference in their entireties herein, disclose the use of textured rolls to emboss a pattern into the metallic strip. A desired texture may be formed on one or both sides of the strip.

Whether the fins are formed by rollers embossing the outside of a tube or textured rolls embossing a strip which is subsequently formed into a tube, the fins are tapered. The fins are thicker at the fin root than at the fin tip. Also, the merge between the fin root and the outside wall of the tube is at a substantial radius. Both the taper and the radius strengthen the fin root. As a result, when the fin is bent to form a nucleate boiling surface, the bend is about a mid-portion of the fin rather than at the fin root.

A problem with present heat exchange tubes are the difficulty with providing an accurate bend in all fins having the same arc and the same radius so that the heat transfer coefficient of the tube is predictable and repeatable. Another problem is that the super heated vapor bubbles are pressurized and interfere with the flow of fluid through the channels reducing the heat transport capability.

SUMMARY OF THE INVENTION

Accordingly, it is an object of the invention to provide a heat transfer surface and a heat exchange tube which do not have the disadvantages of the prior art. It is a feature of the invention that the heat transfer surface has a plurality of vertical fins separated by channels. A conduit formed at the base of one side of each fin provides a point at which the fin may be bent at the root rather than a mid-point. These conduits may also form a capillary tube drawing liquid into the channels between fins notwithstanding the presence of a pressurized vapor bubble. It is another feature of the invention that the opposing side of the heat transfer surface may contain protrusions separated by a distance effective to generate horseshoe turbulence in a fluid. Yet another feature of the invention is that these enhancements may be formed on either wall of the tube, dependent on whether an absorption tube or a evaporation tube is desired.

It is an advantage of the invention that the conduit promotes bending of the fins in a uniform manner at the fin root. It is another advantage of the invention that when the protrusions are in the form of truncated cones, horseshoe turbulence along the surface of the heat exchange tube is maximized with minimal turbulence in a direction perpendicular to the walls of the heat exchange surface. Yet another advantage of the invention is that both surface enhancements may be introduced to a metallic strip by embossing. The embossed substrate may be a strip which is formed into a generally circular configuration with either enhancement as an outer surface. The longitudinal strip edges are welded to form an enhanced heat exchange tube.

In accordance with the invention, there is provided a heat exchange surface. The heat exchange surface has a substrate with an enhancement. The enhancement constitutes substantially parallel rows of vertical fins separated by channels. Conduits run along the channels parallel to the fins. The conduits are located at the base of one side of the fins.

In accordance with a second embodiment of the invention, there is provided a heat exchange tube. The tube is formed from a ductile strip which is shaped into a generally circular configuration with the opposing longitudinal edges welded together to form a tube. The tube has opposing first and second surfaces. A first enhancement is formed on a first surface of the heat transfer tube. This first enhancement constitutes substantially parallel rows of vertical fins separated by channels. Conduits run along the grooves parallel to the fins. The conduits are located at the base of one side of the fins. A second enhancement is formed on a second surface of the tube. The second enhancement constitutes parallel rows of protrusions separated by a distance effective to generate turbulence in a fluid passing along the second surface.

In another aspect, the invention is directed to an elongate heat exchange tube for carrying a fluid in a longitudinal downstream direction. The tube has an inner surface bounding interior, and an outer surface. The inner surface has a longitudinal surface direction and a perpendicular circumferencial surface direction and is formed with a plurality of longitudinal columns of protrusions into the interior. The protrusions in each column have a first longitudinal pitch. The plurality of columns comprises first and second subpluralities of such columns, having protrusions at first and second sets of longitudinal positions, respectively. Each column in the second subplurality is located equidistant between two adjacent columns of the first subplurality. The second set of positions are selected so that an angle between the downstream longitudinal direction and a line from each protrusion in the first subplurality and the next downstream protrusion in an adjacent column of the second subplurality is greater than 45° and less than about 75°. The plurality of columns may be positioned so as to define a plurality of helixes, equal in number to half the number of columns in the plurality of columns. The angle may further be greater than about 55° and less than about 65°.

The above stated objects, features and advantages will become more apparent from the specification and drawings which follow.

IN THE DRAWINGS

DETAILED DESCRIPTION

Figure 1:
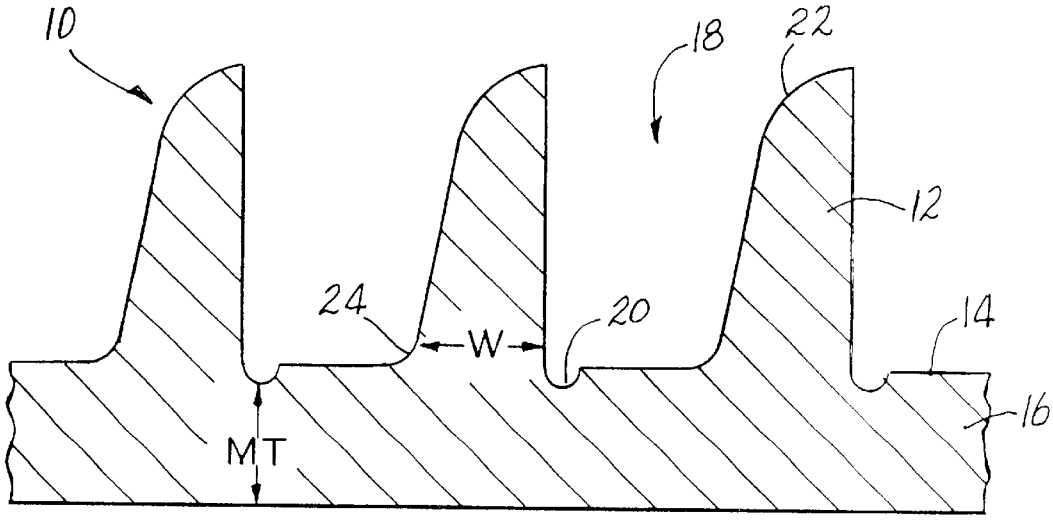
FIG. 1 shows in cross sectional representation the vertical fins of the invention.

FIG. 1 illustrates in cross sectional representation a heat exchange surface 10 in which the enhancement is a plurality of substantially parallel rows of vertical fins 12. The fins 12 are formed in a first surface 14 of a substrate 16. The substrate 16 is formed from any ductile material which has good thermal conductivity such as a metal or metal alloy. Among the preferred materials are copper and copper alloys, aluminum and aluminum alloys, titanium and titanium alloys and stainless steels. Most preferred are copper and copper alloys such as that alloy designated by the Copper Development Association as C122 (deoxidized copper having the nominal composition: 99.9% copper and 0.015–0.040% phosphorous).

The fins 12 are preferably formed by embossing as disclosed in U.S. Pat. No. 5,388,329 entitled "Heat Exchange Tube and Method of Manufacture" by Randlett et al. and is incorporated by reference in its entirety herein. The substrate 16 is passed through a rolling mill having a set of rolls, at least one of which is textured. The texture is in the form of a plurality of roll teeth separated by grooves. The roll teeth penetrate and deform the substrate 16 forming channels 18. The roll teeth further contain a means to form a bend locator 20 at the base of one side of the fin. As a result, the fins are formed to an asymmetric fin shape that is easily bent to one side as detailed below.

The metal from substrate 16 displaced by the roll teeth flows into roll grooves to form fins 12. The shape of the grooves dictates the shape of the fins. The fins may be any desired shape such as a truncated pyramid or trapezoidal base terminating at a knife edge.

One preferred fin shape includes a radius 22 at the tip of the fin opposite the first surface 14. The radius 22 is in a direction such that the fin tip is an off center arc and the fin is longer on the side adjacent the conduit than the side opposite the conduit. Further asymmetry is introduced into the fins by the radius 22 further promoting uniform bending.

The height of the fin 12 is dictated by the intended application. If the first surface 14 is to form the outside wall of a heat exchange tube and the fins are not bent to a nucleate boiling configuration, the fin height is limited by the amount of metal which can be displaced during embossing without tearing of the fins 12 or fracture of the substrate 16. For copper and copper alloys, maximum metal flow is achieved when the maximum crystalline grain size is about 0.050 millimeters and preferably, the average grain size is from about 0.015 mm to about 0.030 mm. Additionally, a lubricant such as polyethylene glycol applied as a mist directly to the rolling mills reduces friction and increases fin height.

The fin height is dependent on both the fin thickness and the fin pitch. When the fins have a nominal thickness of 0.20 mm (0.008 inch) with a nominal pitch of 56 fins/inch, a typical fin height is from about 0.38 mm to about 1.3 mm (0.015–0.050 inch). A more preferred fin height is from about 0.51 mm to about 1.0 mm (0.020 inch–0.040 inch) and most preferably, from about 0.64 mm to about 0.89 mm (0.025–0.035 inch). When the fins have a nominal thickness of 0.13 mm (0.005 inch) and a nominal pitch of 66 fins/inch, a preferred fin height is from about 0.30 mm to about 0.45 mm (0.012 inch–0.018 inch).

The width, "W" of base 24 of a fin 12 is from about 25% to about 50% of the height of the fin to prevent tearing of the fin during embossment forming.

One preferred bend locator is a conduit. The conduits 20 have a width equal to from about 5% to about 20% of the width of a channel 18 and preferably, from about 8% to about 12% of the width of the channel. The maximum depth of the conduit is generally about equal to one half the conduit width. The conduit depth is minimized since the conduit reduces the minimum tube wall thickness, "MT", thereby reducing the maximum pressure which may be safely exposed to the tube. A preferred depth for the conduit 20 is from about 0.025 mm to about 0.075 mm (0.001 inch–0.003 inch).

Figure 2:
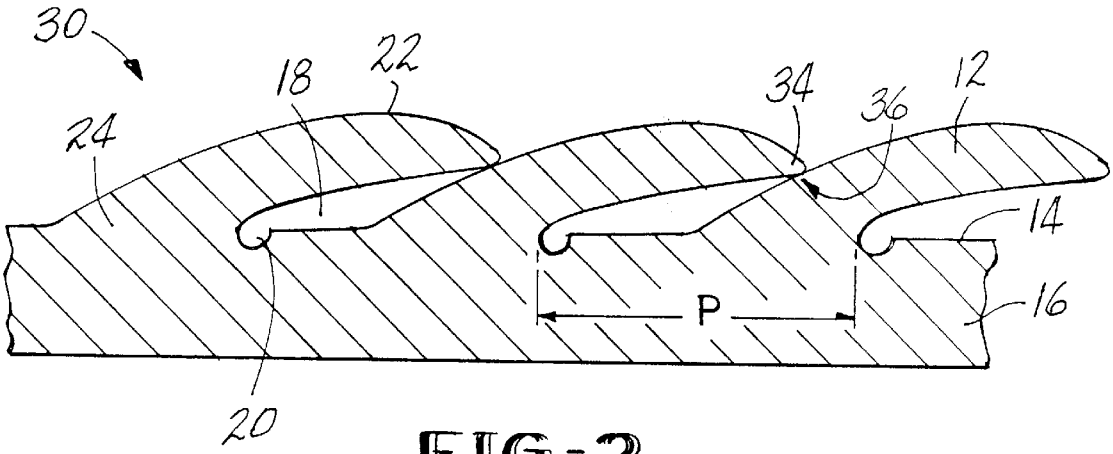
FIG. 2 shows in cross sectional representation the bending of the vertical fins of FIG. 1.

When the fins 12 are for a nucleate boiling configuration, the heat exchange surface 30 illustrated in FIG. 2 is applicable. The fins 12 are bent by any suitable means such as passing through a rolling mill. The fins 12 are bent so the tip 34 of one fin abuts, and preferably contacts, the mid-point 36 of an adjacent fin. When the substrate 16 is formed into a circular configuration, the fin tips separate slightly from the adjacent mid-point. Contacting the mid-point of an adjacent fin prior to forming into the circular configuration assures a uniform sized aperture is formed for nucleate boiling. The size of the aperture is determined by the diameter of the tube formed and subsequent sizing of the tube after forming. The larger the diameter of the tube, the smaller the formed apertures. Subsequent sizing of the tube such as by passing through sizing rolls is effective to fine tune the aperture size.

The bend locator 20 and the radius 22 facilitate fin bending. The bend locator 20 is formed to any shape effective to remove the radius from one side of the fin base 24, such as a hemispherical depression, a v-shaped notch or a right angle. The bend locator 20 causes each fin to deform at the fin base 24 when subjected to a deforming stress such as generated by a rolling mill. The radius 22 also promotes bending by ensuring that the force applied by the rolling mill is tangential to the first surface 14 of the substrate 16 rather than perpendicular to the first surface.

For the nucleate boiling embodiment, the preferred fin height is from about 0.38 mm to about 1.0 mm (0.015–0.040 inch) and preferably, from about 0.51 mm to about 0.64 mm (0.020–0.025 inch). The pitch, "P", the distance from a point on a fin 12 to the same point on an adjacent fin is slightly less than the fin height. This is so that when the fins bend over, the tip 34 of one fin will abut, and preferably contact, the mid-point 36 of an adjoining fin. Preferably, the pitch is from about 60% to about 95% of the fin height and more preferably, the pitch is from about 70% to about 90% of the fin height.

When the first surface 14 forms an inside wall of a heat exchange tube, similar unbent fin dimensions may be utilized with the additional provision that to reduce pressure loss within the tube, the ratio of the fin height to the inside diameter of the tube is less than about 0.04 and preferably, is in the range of from about 0.02 to about 0.03. When the fins are bent over, as in the nucleate boiling configuration, the pressure loss is not a concern and the fin height is independent of inside diameter of the tube. However, for ease of formability and bendability, fin heights similar to that used when the nucleate boiling surface is on the outside wall of the tube are utilized.

Figure 3:
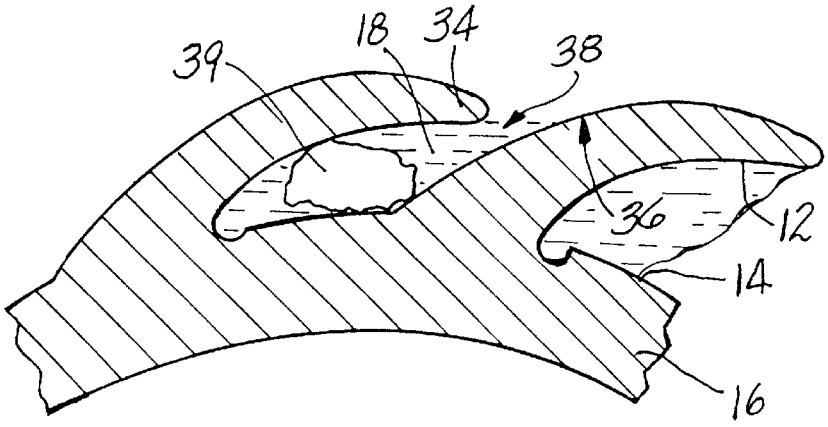
FIG. 3 shows in cross sectional representation the fins of FIG. 2 being opened to a nucleate boiling configuration by tube forming.

With reference to FIG. 3, when the substrate 16 is formed into a circular configuration for forming a welded tube and the first surface 14 constitutes the outside wall, the fins 16 separate slightly such the tip 34 of one fin and the mid-point 36 of an adjacent fin define a narrow aperture 38. Since the substrate is bent to a generally circular configuration, the radius of curvature at all points of the first surface 14 is about the same and the aperture 38 has a uniform width along the entire length and circumference of the welded tube.

Unlike other methods of forming the apertures, the present method separates the fin tips from the adjacent mid-points in a controlled fashion providing accurate and reproducible control of the aperture dimensions.

When the heat exchange surface 30 is utilized for nucleate boiling, a fluid flowing within channels 18 is heated to a temperature sufficient to generate vapor bubbles 39. As the vapor bubbles 39 become super heated, they expand and increase in internal pressure until they reach a critical size and are expelled through the aperture 38. As the vapor bubbles 39 expand and increase in pressure, they displace the fluid in the channel 18 reducing fluid contact with the heat transfer surface of the tube. In the tubes of the invention, however, the conduit 20 and channel 18 provide a mechanism for continued replenishment of fluid notwithstanding the presence of vapor bubbles 39 by capillary action in the narrow conduit.

Figure 4:
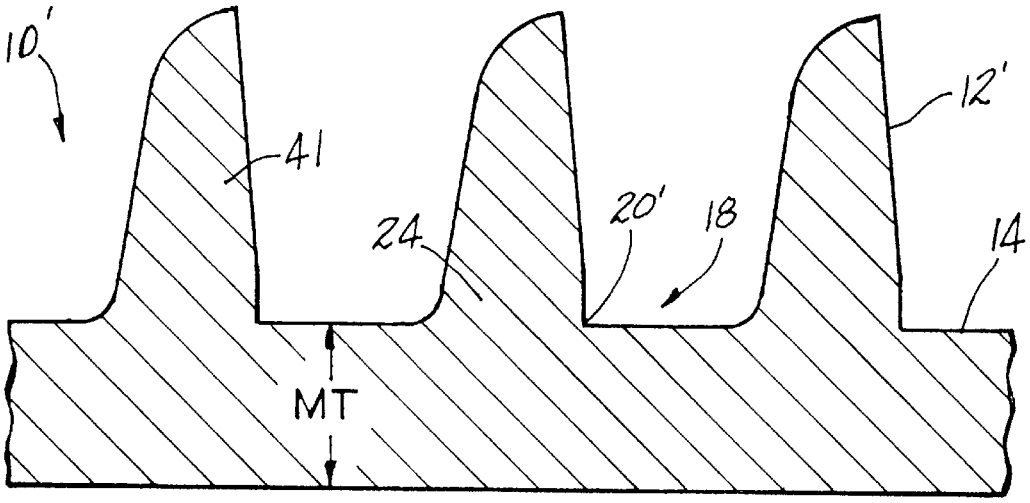
FIG. 4 shows in cross sectional representation the vertical fins of the invention in accordance with a second embodiment of the invention.

FIG. 4 illustrates in cross sectional representation another embodiment of the vertical fins 12' of the invention. Rather than a conduit as a bend locator, one edge of the fin base 24 is substantially perpendicular to the first surface 14. The remainder of the fin edge 41 has a slight taper to facilitate removal from the forming roll teeth. This embodiment has all the advantages achieved by the previous embodiment such as facilitating bending of the fin about the fin base with the further benefit that the minimum tube thickness, "MT", is not reduced by the conduit 20'.

Figure 5:
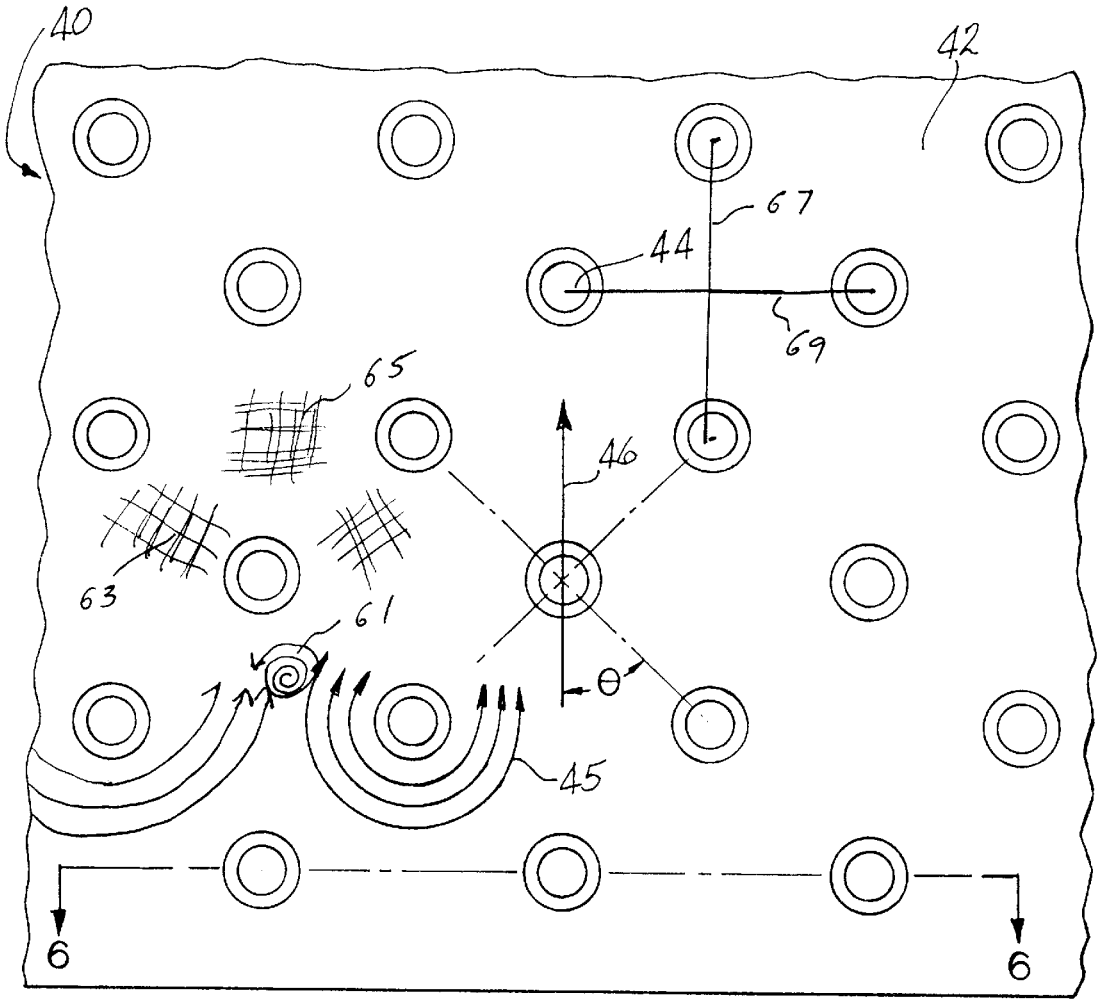
FIG. 5 shows in top planar view turbulence generating protrusions in accordance with the invention.

FIG. 5 illustrates in top planar view a heat exchange surface 40 for generating planar surface turbulence in a fluid passing along a second surface 42. A plurality of parallel rows of protrusions 44 are formed on the second surface 42 by any suitable means such as embossing. One suitable method of embossing is to pass a ductile substrate through a rolling mill having a set of rolls, at least one of which is textured. In one preferred embossing sequence, a first pass through a rolling mill generates both the vertical fins illustrated in either FIG. 1 or FIG. 4 and on the opposite side of the substrate, the protrusions 44 illustrated in FIG. 5. A second pass through a rolling mill bends the fins to form the nucleate boiling surface illustrated in FIG. 2. The protrusions 44 may take any desired shape effective to generate a vortex in a heat transfer liquid flowing along the longitudinal axis 46 of the heat exchange surface 40. Cones and truncated cones are preferred shapes. Truncated cones maximize turbulence along the second surface 42 by generation of a pressure front as indicated by the arrows 45 representing the direction of fluid flow. The pressure front generates a plurality of surface vortexes in the flowing fluid. The truncated cones also minimize turbulence in the direction perpendicular to the second surface 42.

Less preferred shapes for the protrusions are those that present a corner or a flat surface to the flow of the heat transfer liquid. A flat surface generates turbulence perpendicular to the second surface 42. A corner changes the direction of the fluid flow without forming a vortex and leads to stagnant flow on the downstream side of the protrusion that is shielded by the corner.

The vortex 61 forms to the sides (hatched region 63) and to the downstream side (hatched region 65) of the conical protrusions 44. The circular flow of the heat transfer liquid in the vortex maintains the fluid in close contact with the second surface 42 maximizing heat transfer.

The benefit of the vortexes is optimized by spacing the protrusions such that the vortex is substantially dissipated before the heat transfer fluid encounters the next protrusion. The pitch 67 between an arbitrary point on a protrusion to the same arbitrary point on the next protrusion along the longitudinal axis is sufficiently large to allow for dissipation of the vortexes 61. The pitch along the transverse axis (or along the circumference when the heat transfer surface is a tube) is sufficiently large to minimize the pressure drop.

The ratio of the pitch along the transverse axis 69 to the pitch along the longitudinal axis is at least 1:1 and preferably from about 1.2:1 to about 3:1 and most preferably from about 1.5:1 to about 2.0:1.

In one preferred embodiment, the longitudinal pitch is from about 0.080 inch to about 0.100 inch and the circumferential pitch is from about 0.150 inch to about 0.170 inch. With nominal values of 0.092 inch for the longitudinal pitch and 0.160 inch for the circumferential pitch, the ratio is 1.74 and the tube is enhanced with 136 cones per $inch^2$.

Figure 6:
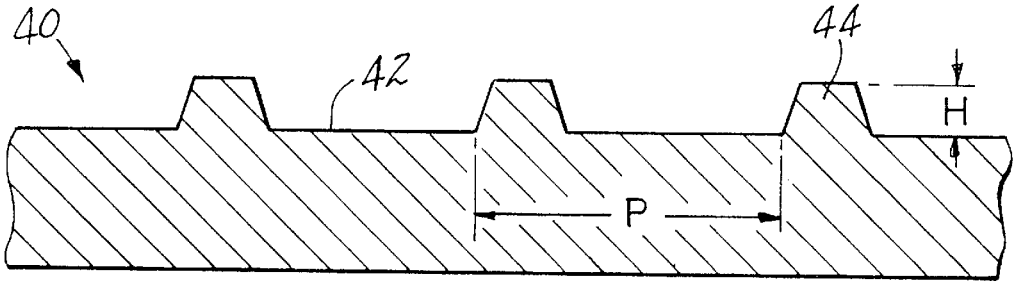
FIG. 6 shows in cross sectional representation the turbulence generating protrusions of FIG. 5.

FIG. 6 shows the heat exchange surface 40 in cross sectional representation. The ratio of the pitch "P" to the height, "H", of the protrusions 44 is from about 3 to about 7. More preferably, the ratio P:H is from about 4 to about 6. The height "H" is from about 0.25 mm to about 1.3 mm (0.010–0.050 inch) and preferably from about 0.30 mm to about 0.56 mm (0.012–0.022 inch). Increasing the height of the protrusions 44 increases turbulence, but higher protrusions on an inside wall of the tube also cause a pressure drop increase in the fluid flowing through the tube.

Referring back to FIG. 5, when a fluid flows across the second surface 42, the protrusions 44 are preferably aligned such that the angle, θ, between the direction of fluid flow as represented by arrow 46 and the rows of protrusions 44 is from about 40° to about 75° and preferably from about 45° to about 70° and most preferably from about 55° to about 65°. In the illustrated embodiment, the aforementioned pitch ratio is equal to the tangent of θ (the tangents of 45°, 55°, 65°, 70° and 75° being respectively, 1, 1.428, 2.1445, 2.747, and 3.723). As shown in FIG. 5, when θ is 45°, the efficiency index (heat transfer enhancement ratio divided by friction increase ratio) is superior to when θ is on the order of 30°. FIG. 5 was generated from a computer model using a fluid with a Reynolds number of 30,000 and a fin height of 0.5 mm.

Figure 7:
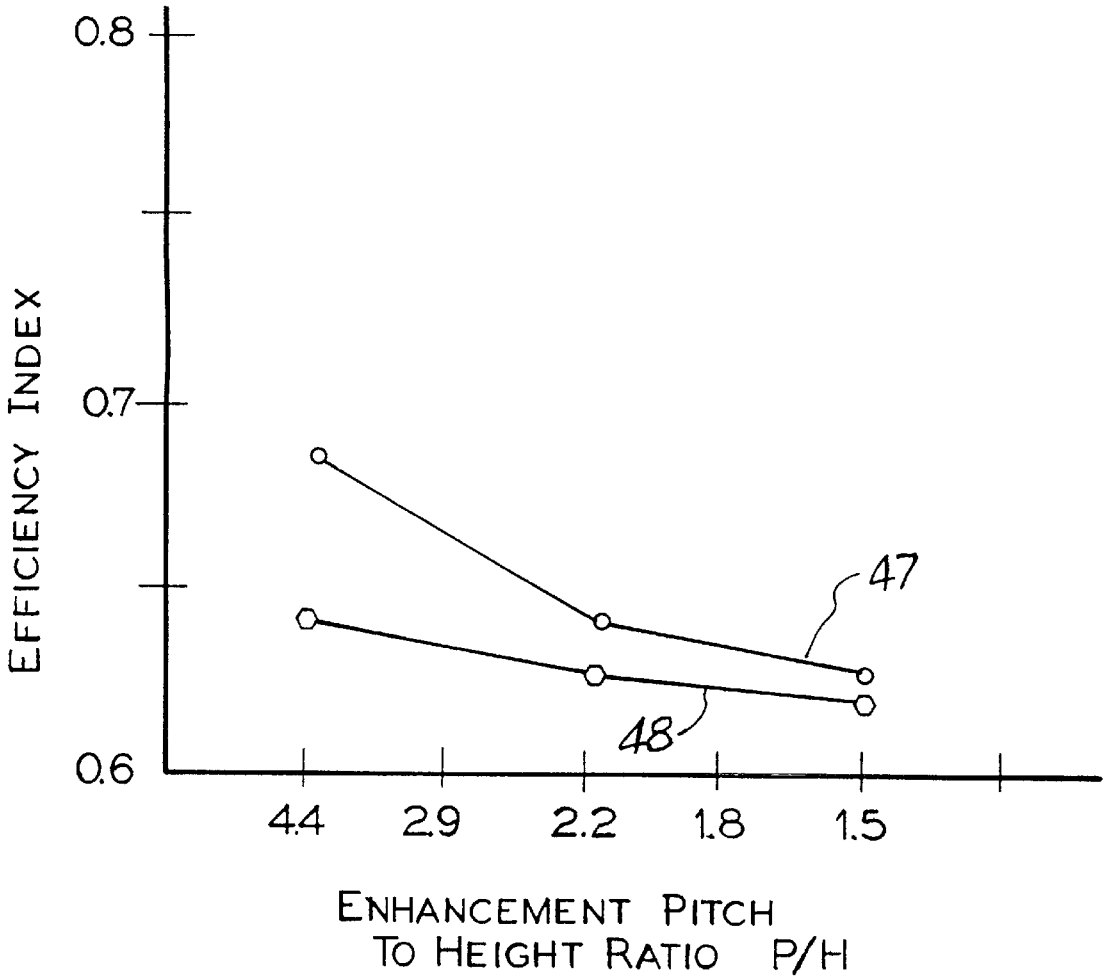
FIG. 7 shows in graphical representation the relationship between the heat transfer efficiency and the ratio of pitch to protrusion height.

FIG. 7 shows in graphical representation the improvement in the heat transfer efficiency index when θ is 45°, reference numeral 47 as compared to a θof 30°, reference numeral 48. FIG. 7 also identifies the benefits achieved by having an enhancement pitch to height ratio, P:H, in excess of 3.0 and preferably, in excess of about 4.0.

Figure 8:
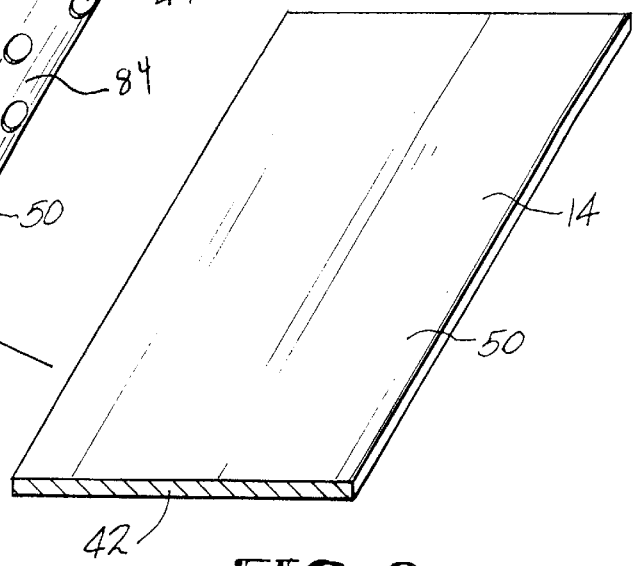
FIG. 8 shows in cross sectional representation a ductile metal strip for embossing with the enhancement patterns of the invention.

The heat transfer surfaces of the invention have particular utility for heat exchange tubes. Referring to FIG. 8, a heat exchange tube is formed by conventional means. A ductile strip 50, typically copper or a copper alloy, is formed with desired surface enhancements. A first surface 14 is formed with a first enhancement such as substantially parallel rows of vertical fins separated by channels with conduits running along the channels parallel to the fins and the conduits located at the base of one side of the fin as illustrated in FIG. 1. The fins may be bent over to form a nucleate surface as illustrated in FIG. 3. A second enhancement is formed on a second surface 42. The second enhancement may constitute parallel rows of protrusions separated by a distance effective to generate turbulence in a fluid passing along the second surface 42 as illustrated in FIG. 5.

The ductile strip is formed into a generally circular configuration with the opposing longitudinal edges of the strip welded together to form a tube having opposing first surface 14 and second surface 42.

The tube is essentially symmetric about a longitudinal axis 80 and has both an inner wall 82 and an outer wall 84. The inner wall 82 defines a circumference and an inside diameter measured along the transverse axis 86 of the tube from the base of a protrusion to the base of a protrusion on the opposing side.

Figure 9:
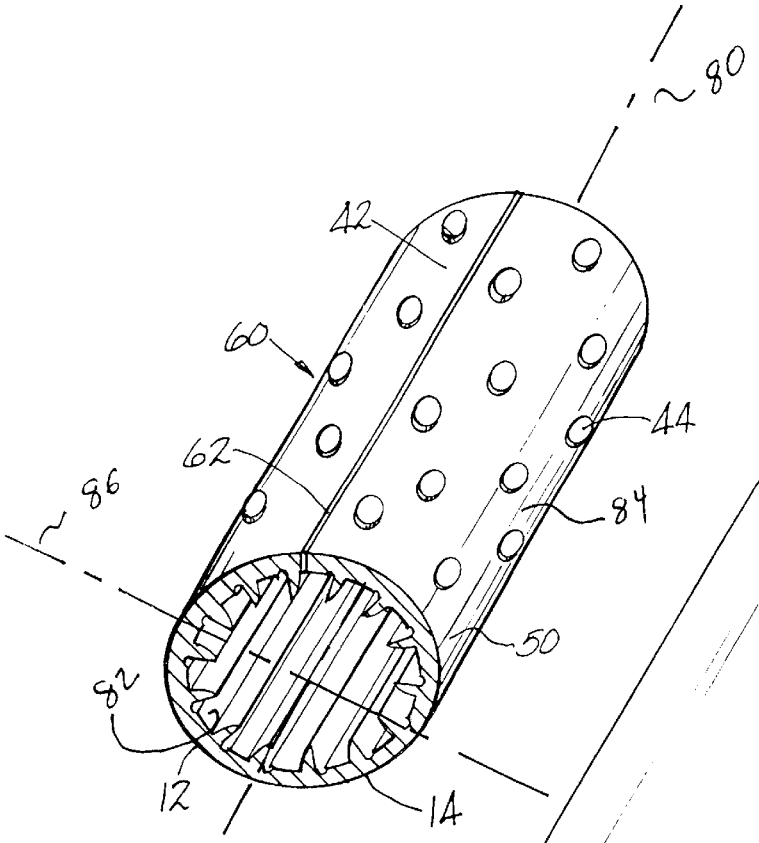
FIG. 9 shows in isometric view an absorption tube formed with the enhancements of the invention.

FIG. 9 illustrates in isometric view an absorption type heat exchange tube 60. The ductile metal strip 50 has been formed into a generally circular configuration and the longitudinal edges of the metallic strip welded together with a longitudinal weld bead 62. In the embodiment of FIG. 9, the first surface 14 forms the inner wall of the heat exchange tube 60 while the second surface 42 forms the outer wall of the heat exchange tube 60. In this embodiment, the fins are not bent and function to increase the surface area of the inside wall of the tube.

Figure 10:
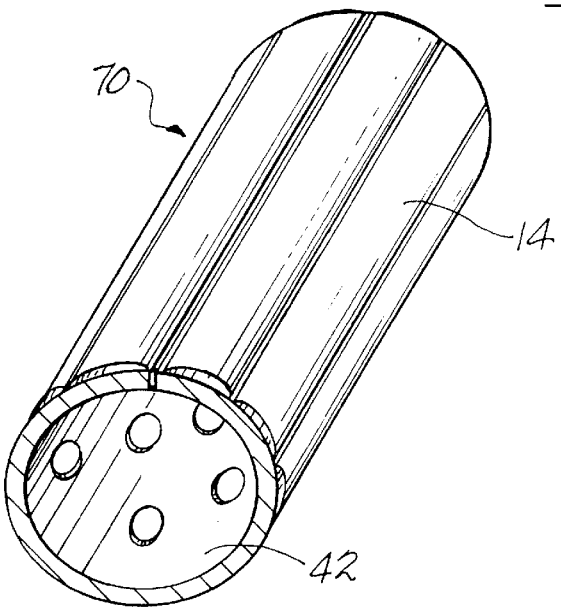
FIG. 10 shows in isometric view an evaporation tube formed with the enhancements of the invention.

FIG. 10 illustrates an evaporation type heat exchange tube 70 in which the first surface 14 forms an outside wall of the heat exchange tube 70 and the second surface 42 forms an inside wall. This type of tube is particularly suitable for applications in which a relatively warm fluid travels inside the tube and heat is transferred through the tube by nucleate boiling of an external fluid flowing along the first surface 14.

The patents and patent applications set forth in the application are intended to be incorporated herein by reference.

It is apparent that there has been provided in accordance with the present invention, a heat exchange tube which fully satisfies the objects, means and advantages set forth hereinabove. While the invention has been described in combination with embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A method of manufacturing a heat exchange tube comprising:

providing a ductile substrate having first and second services;

passing said ductile substrate through a rolling mill to emboss a plurality of truncated conical protrusions on said first surface;

forming the substrate into a tube so that the first surface becomes the inner surface of the tube and the second surface becomes the outer surface of the tube so that the protrusions are disposed in a plurality of longitudinal columns, such protrusions in each column having a first longitudinal pitch, the plurality of longitudinal columns comprising:

a first subplurality of such columns each having such protrusions at a first set of longitudinal positions; and a second subplurality of such columns each having such protrusions at a second set of longitudinal positions, each column in the second subplurality located equidistant between two adjacent columns of the first subplurality, the second set of positions selected so that an angle θ between the downstream longitudinal direction and a line from each protrusion in the first subplurality and the next most downstream protrusion in an adjacent column of the second subplurality is greater than about 55 degrees and less than about 75 degrees.

2. The method of claim 1 wherein said passing step generates a plurality of fins on said second surface.

3. The method of claim 2 wherein a second passing step bends said fins.

4. An elongate heat exchange tube for carrying a fluid in a longitudinal downstream direction having:

an inner surface bounding an interior; and an outer surface, wherein the inner surface has a longitudinal surface direction and is formed with a plurality of longitudinal columns of substantially frustoconical protrusions into said interior, such protrusions in each such column having a first longitudinal pitch, the plurality of longitudinal columns comprising:

a first subplurality of such columns each having such protrusions at a first set of longitudinal positions; and a second subplurality of such columns each having such protrusions at a second set of longitudinal positions, each column in the second subplurality located equidistant between two adjacent columns of the first subplurality, the second set of positions selected so that an angle θ between the downstream longitudinal direction and a line from each protrusion in the first subplurality and the next most downstream protrusion in an adjacent column of the second subplurality is greater than about 55 degrees and less than about 75 degrees.

5. The tube of claim 4 wherein the plurality of columns are positioned so as to define a plurality of helixes, equal in number to half the number of columns in the plurality of columns and wherein θ is greater than about 55 degrees and less than about 65 degrees.

6. The tube of claim 4 wherein said outer surface is formed with a plurality of fins.

7. The tube of claim 4 wherein the inner surface has a circumferential surface direction and the first and second subpluralities of such columns each have a first circumferential pitch and wherein a ratio of said first circumferential pitch to said first longitudinal pitch is from about 1.43:1 to about 3.723:1.

8. The tube of claim 7 wherein a ratio of the first circumferential pitch to a height of the substantially frustoconical protrusions is from about 3 to about 7.

9. The tube of claim 8 wherein said height is from about 0.012 inch to about 0.022 inch.

10. An elongate heat exchange tube for carrying a fluid in a longitudinal downstream direction having:

an inner surface bounding an interior; and an outer surface, wherein the inner surface has a longitudinal surface direction and is formed with a plurality of longitudinal columns of embossed protrusions into said interior, such protrusions formed substantially as truncated cones for generating vortices in the fluid, such protrusions in each such column having a first longitudinal pitch, the plurality of longitudinal columns positioned so as to define a plurality of helixes, equal in number to half the number of columns in the plurality of columns and comprising:

a first subplurality of such columns each having such protrusions at a first set of longitudinal positions, and a second subplurality of such columns each having such protrusions at a second set of longitudinal positions, each column in the second subplurality located equidistant between two adjacent columns of the first subplurality, the second set of positions selected so that an angle θ between the downstream longitudinal direction and a line from each protrusion in the first subplurality and the next most downstream protrusion in an adjacent column of the second subplurality is greater than about 55 degrees and less than about 75 degrees.

11. The tube of claim 10 wherein θ is greater than about 55 degrees and less than about 65 degrees.

12. The tube of claim 10 wherein said outer surface is formed with a plurality of fins.

13. An elongate heat exchange tube for carrying a fluid in a longitudinal downstream direction having:

an inner surface bounding an interior; and an outer surface, wherein the inner surface has a longitudinal surface direction and is formed with a plurality of longitudinal columns of protrusions into said interior, each such protrusion presenting a curved surface to fluid flowing in the longitudinal downstream direction through the heat exchange tube, such protrusions in each such column having a first longitudinal pitch, the plurality of longitudinal columns comprising;

a first subplurality of such columns each having such protrusions at a first set of longitudinal positions; and a second subplurality of such columns each having such protrusions at a second set of longitudinal positions, each column in the second subplurality located equidistant between two adjacent columns of the first subplurality, the second set of positions selected so that all angle θ between the downstream longitudinal direction and a line from each protrusion in the first subplurality and the next most downstream protrusion in an adjacent column of the second subplurality is greater than about 55 degrees and less than about 75 degrees and wherein the inner surface has a circumferential surface direction and the first and second subpluralities of such columns each have a first circumferential pitch and wherein a ratio of the first circumferential pitch to a height of the protrusions is from about 3 to about 7.

14. An elongate heat exchange tube for carrying a fluid in a longitudinal downstream direction having:

an inner surface bounding an interior; and an outer surface, wherein the inner surface has a longitudinal surface direction and is formed with a plurality of longitudinal columns of protrusions into said interior, each such protrusion presenting a curved surface to fluid flowing in the longitudinal downstream direction through the heat exchange tube, such protrusions in each such column having a first longitudinal pitch, the plurality of longitudinal columns comprising:

a first subplurality of such columns each having such protrusions at a first set of longitudinal positions; and a second subplurality of such columns each having such protrusions at a second set of longitudinal positions, each column in the second subplurality located equidistant between two adjacent columns of the first subplurality, the second set of positions selected so that an angle θ between the downstream longitudinal direction and a line from each protrusion in the first subplurality and the next most downstream protrusion in an adjacent column of the second subplurality is greater than about 55 degrees and less than about 75 degrees and wherein the inner surface has a circumferential surface direction and the first and second subpluralities of such columns each have a first circumferential pitch and wherein the first circumferential pitch and first longitudinal pitch are sufficient to allow substantial dissipation of a vortex in the fluid as such fluid flows between one such protrusion and a next such protrusion encountered by the fluid.

* * * * *